US010113539B2

(12) United States Patent
Sugamura et al.

(10) Patent No.: US 10,113,539 B2
(45) Date of Patent: Oct. 30, 2018

(54) CONTROL VALVE FOR VARIABLE DISPLACEMENT COMPRESSOR

(71) Applicant: TGK CO., LTD., Tokyo (JP)

(72) Inventors: Ryota Sugamura, Tokyo (JP); Shinji Saeki, Tokyo (JP); Masaaki Tonegawa, Tokyo (JP)

(73) Assignee: TGK CO., LTD., Tokyo (JP)

( * ) Notice: Subject to any disclaimer, the term of this patent is extended or adjusted under 35 U.S.C. 154(b) by 232 days.

(21) Appl. No.: 15/078,994

(22) Filed: Mar. 23, 2016

(65) Prior Publication Data

US 2016/0290326 A1 Oct. 6, 2016

(30) Foreign Application Priority Data

Apr. 2, 2015 (JP) ..... 2015-075994

(51) Int. Cl.
*F04B 27/18* (2006.01)

(52) U.S. Cl.
CPC .. *F04B 27/1804* (2013.01); *F04B 2027/1818* (2013.01); *F04B 2027/1831* (2013.01); *F04B 2027/1859* (2013.01)

(58) Field of Classification Search
CPC ..... F04B 27/1804; F04B 2027/1859; F04B 2027/1818; F04B 2027/1831; Y10T 137/87217
USPC ..... 137/596.17; 417/222.2
See application file for complete search history.

(56) References Cited

U.S. PATENT DOCUMENTS 5,771,933 A * 6/1998 Akamatsu ..... B60T 13/665 137/596.17
6,142,445 A * 11/2000 Kawaguchi ..... F04B 27/1804 251/129.15
6,354,811 B1 * 3/2002 Ota ..... F04B 27/1804 137/596.17
7,159,615 B2 * 1/2007 Yamamoto ..... F16K 31/0624 137/596.17

(Continued)

FOREIGN PATENT DOCUMENTS

JP 2014-095463 5/2014 ..... F16K 31/06

*Primary Examiner* — Eric Keasel
(74) *Attorney, Agent, or Firm* — Martine Penilla Group, LLP

(57) ABSTRACT

A control valve includes: a body having a main passage through which a discharge chamber and a control chamber communicate, and a sub-passage through which the control chamber and a suction chamber communicate; a main valve seat provided in the main passage; a main valve element configured to touch and leave the main valve seat to close and open a main valve; a sub-valve seat provided in the sub-passage; a sub-valve element configured to touch and leave the sub-valve seat to close and open a sub-valve; a solenoid configured to generate a drive force in a valve closing direction of the main valve; an actuating rod for transmitting the drive force of the solenoid to the main valve element and the sub-valve element; a spring for applying a biasing force to the main valve in a valve opening direction; a spring for applying a biasing force to the sub-valve in a valve closing direction; and a differential pressure valve opening mechanism configured to open the sub-valve when a pressure difference between a control pressure in the control chamber and a suction pressure in the suction chamber becomes a preset pressure difference or larger.

12 Claims, 8 Drawing Sheets

(56) References Cited

U.S. PATENT DOCUMENTS

| | | | | |
|---|---|---|---|---|
| 7,503,754 | B2 * | 3/2009 | Okii | F04B 27/1804 417/222.2 |
| 7,644,729 | B2 * | 1/2010 | Cho | F04B 27/1804 417/222.2 |
| 8,079,827 | B2 * | 12/2011 | Iwa | F04B 27/1804 417/222.2 |
| 8,434,517 | B2 * | 5/2013 | Okamoto | F16K 31/0655 137/596.17 |

* cited by examiner

CONTROL VALVE FOR VARIABLE DISPLACEMENT COMPRESSOR

CLAIM OF PRIORITY

This application claims priority to Japanese Patent Application No. JP2015-075994, filed on Apr. 2, 2015, of which is incorporated herein by reference.

BACKGROUND OF THE INVENTION

1. Field of the Invention

The present invention relates to a control valve for controlling the discharging capacity of a variable displacement compressor.

2. Description of the Related Art

An automotive air conditioner is generally configured by arranging and placing a compressor, a condenser, an expander, an evaporator, and so forth in a refrigeration cycle. The compressor is, for example, a variable displacement compressor (hereinafter also referred to simply as a "compressor") capable of varying the refrigerant discharging capacity in order to maintain a constant level of cooling capacity irrespective of the engine speed. In this compressor, a piston for compression is linked to a wobble plate, which is mounted to a rotational shaft driven by an engine. The angle of the wobble plate is changed to change the stroke of the piston, by which the refrigerant discharging rate is regulated. The angle of the wobble plate is changed continuously by supplying part of the discharged refrigerant into a hermetically-closed control chamber and thus changing the balance of pressures working on both faces of the piston. The pressure (referred to as a "control pressure" below) Pc in this control chamber is controlled by, for example, a control valve provided between a discharge chamber and the control chamber of the compressor.

One example of such a control valve includes a main valve provided in a main passage through which a discharge chamber and a control chamber communicate with each other, and a sub-valve provided in a sub-passage through which the control chamber and a suction chamber communicate with each other, both of which are driven by a single solenoid (refer to Japanese Unexamined Patent Application Publication No. 2014-95463, for example). With this control valve, during steady operation of the air conditioner, the opening degree of the main valve is controlled in a state where the sub-valve is closed. This enables control of the control pressure Pc as mentioned above, so as to control the discharging capacity of the compressor. In contrast, at the startup of the conditioner, the sub-valve is opened in a state where the main valve is closed. This enables a so-called bleeding function of rapidly lowering the control pressure Pc so that the compressor can relatively quickly enter a maximum capacity operation state.

RELATED ART LIST (1) Japanese Unexamined Patent Application Publication No. 2014-95463.

In such a control valve, however, when the solenoid is switched off, which causes the main valve to be fully open at once, the control pressure Pc may suddenly rise. If the control pressure Pc becomes excessively high, refrigerant may leak out through a sealing portion inside the compressor.

SUMMARY OF THE INVENTION

The present invention has been made in view of such circumstances, and a purpose thereof is to provide a control valve for a variable displacement compressor, capable of preventing or reducing sudden rise in control pressure when a solenoid is turned off.

One embodiment of the present invention relates to a control valve for a variable displacement compressor, for varying a discharging capacity of the compressor for compressing refrigerant introduced into a suction chamber and discharging the compressed refrigerant from a discharge chamber, by regulating a flow rate of refrigerant introduced from the discharge chamber to a control chamber or a flow rate of refrigerant delivered from the control chamber to the suction chamber. The control valve includes: a body having a main passage through which the discharge chamber and the control chamber communicate with each other, and a sub-passage through which the control chamber and the suction chamber communicate with each other; a main valve seat provided in the main passage; a main valve element configured to touch and leave the main valve seat to close and open a main valve; a sub-valve seat provided in the sub-passage; a sub-valve element configured to touch and leave the sub-valve seat to close and open a sub-valve; a solenoid configured to generate a drive force in a valve closing direction of the main valve; an actuating rod for transmitting the drive force of the solenoid to the main valve element and the sub-valve element; a first biasing member for applying a biasing force to the main valve in a valve opening direction; a second biasing member for applying a biasing force to the sub-valve in a valve closing direction; and a differential pressure valve opening mechanism configured to open the sub-valve when a pressure difference between a control pressure in the control chamber and a suction pressure in the suction chamber becomes a preset pressure difference or larger.

By employing the embodiment, when the solenoid is powered off and the pressure difference between the control pressure in the control chamber and the suction pressure in the suction chamber thus becomes the preset pressure difference or larger, the differential pressure valve opening mechanism is activated to open the sub-valve. This prevents or reduces a sudden increase in the control pressure.

DETAILED DESCRIPTION OF THE INVENTION

Figure 1:
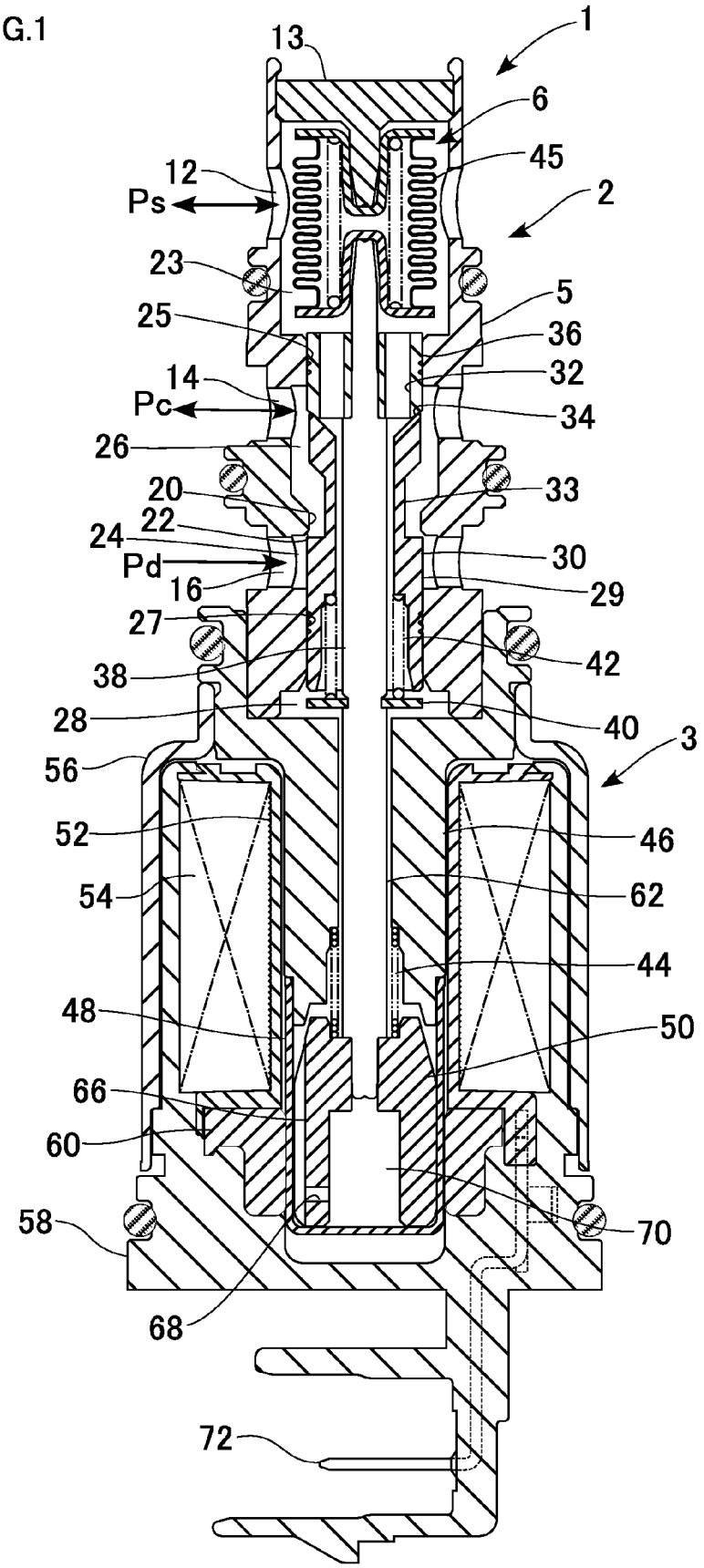
FIG. 1 is a cross-sectional view illustrating a structure of a control valve according to a first embodiment.

The invention will now be described by reference to the preferred embodiments. This does not intend to limit the scope of the present invention, but to exemplify the invention.

Embodiments of the present invention will now be described in detail with reference to the accompanying drawings. In the following description, for convenience of description, the positional relationship in each structure may be expressed as "vertical" or "up-down" with reference to how each structure is depicted in the drawings.

First Embodiment

FIG. 1 is a cross-sectional view illustrating a structure of a control valve according to a first embodiment.

The control valve 1 is structured as an electromagnetic valve for controlling the discharging capacity of a not-shown variable displacement compressor (also referred to simply as a "compressor"), which is a device to be controlled and which is installed in a refrigeration cycle of an automotive air conditioner. The compressor compresses refrigerant flowing through the refrigeration cycle into a high-temperature and high-pressure gaseous refrigerant, and discharges the compressed gaseous refrigerant. The gaseous refrigerant is condensed by a condenser (external heat exchanger) and then adiabatically expanded by an expander into a low-temperature and low-pressure spray of refrigerant. The low-temperature and low-pressure refrigerant is evaporated by an evaporator, and the air inside the vehicle is cooled by the evaporative latent heat. The refrigerant evaporated by the evaporator is returned to the compressor and thus circulates through the refrigeration cycle. The compressor has a rotational shaft rotated by an engine of the automobile. A piston for compression is linked to a wobble plate mounted on the rotational shaft. The angle of the wobble plate is changed to change the stroke of the piston and to thus regulate the refrigerant discharging rate. The control valve 1 controls the flow rate of refrigerant introduced from the discharge chamber to the control chamber of the compressor to change the angle of the wobble plate and thus the discharging capacity of the compressor. Although the control chamber of the present embodiment is a crankcase, the control chamber may alternatively be a pressure chamber separately provided in or outside of the crankcase in a modification.

The control valve 1 is structured as a so-called Ps sensing valve for controlling the flow rate of refrigerant introduced from the discharge chamber into the control chamber so as to keep a suction pressure Ps (corresponding to a "pressure to be sensed") of the compressor at a preset pressure. The control valve 1 is formed of an integral assembly of a valve unit 2 and a solenoid 3. The valve unit 2 includes a main valve for opening and closing a refrigerant passage through which part of discharged refrigerant is introduced into the control chamber while the compressor is in operation, and a sub-valve, which functions as a so-called a bleed valve for letting refrigerant in the control chamber out to the suction chamber at the startup of the compressor. The solenoid 3 drives the main valve in a valve opening or closing direction to adjust the opening degree thereof and thus control the flow rate of refrigerant introduced into the control chamber. The valve unit 2 includes a stepped cylindrical body 5, the main valve and the sub-valve formed inside the body 5, a power element 6 for generating a counterforce against a force from the solenoid 3 (hereinafter also referred to as a solenoid force or a drive force of the solenoid) to adjust the opening degree of the main valve, and so force. The power element 6 functions as a "pressure sensing part."

The body 5 has ports 12, 14, and 16 formed in this order from a top end thereof. The port 12 functions as a "suction chamber communication port" communicating with the suction chamber of the compressor. The port 14 functions as a "control chamber communication port" communicating with the control chamber of the compressor. The port 16 functions as a "discharge chamber communication port" communicating with the discharge chamber of the compressor. An end member 13 is fixed to the body 5 in such a manner as to close an upper end opening of the body 5. A lower end part of the body 5 is connected to an upper end part of the solenoid 3.

Inside the body 5, a main passage, which is an internal passage through which the port 16 and the port 14 communicate with each other, and a sub-passage, which is an internal passage through which the port 14 and the port 12 communicate with each other, are formed. The main valve is provided in the main passage while the sub-valve is provided in the sub-passage. Thus, the control valve 1 has a structure in which the power element 6, the sub-valve, the main valve, and the solenoid 3 are arranged in this order from one end thereof. In the main passage, a main valve hole 20 and a main valve seat 22 are provided. In the sub-passage, a sub-valve hole 32 and a sub-valve seat 34 are provided.

The port 12 allows a working chamber 23 defined (formed) in an upper part of body 5 and the suction chamber to communicate with each other. The power element 6 is disposed in the working chamber 23. The port 16 allows refrigerant at a discharge pressure Pd to be introduced from the discharge chamber. A main valve chamber 24 is formed between the port 16 and the main valve hole 20, and the main valve is disposed therein. Refrigerant whose pressure is changed to a control pressure Pc through the main valve is delivered toward the control chamber through the port 14 during steady operation of the compressor, while refrigerant at the control pressure Pc discharged from the control chamber is introduced through the port 14 at the startup of the compressor. A sub-valve chamber 26 is formed between the port 14 and the main valve hole 20, and the sub-valve is disposed therein. The sub-valve chamber 26 functions as a "capacity chamber". Refrigerant at the suction pressure Ps is introduced through the port 12 during steady operation of the compressor, while refrigerant whose pressure is changed to the suction pressure Ps through the sub-valve is delivered toward the suction chamber through the port 12 at the startup of the compressor.

In other words, while the main valve is open, the port 16 functions as a "lead-in port" for introducing refrigerant from the discharge chamber and the port 14 functions as a "lead-out port" for delivering refrigerant toward the control chamber. In contrast, while the sub-valve is open, the port 14 functions as a "lead-in port" for introducing refrigerant from the control chamber, while the port 12 functions as a "lead-out port" for delivering refrigerant toward the suction chamber. The port 14 functions as a "lead-in/out port" for introducing or delivering refrigerant, depending on whether the main valve and the sub-valve are in the open or closed states.

The main valve hole 20 is formed between the main valve chamber 24 and the sub-valve chamber 26, and the main valve seat 22 formed at an end portion of a lower end opening of the main valve hole 20. A guiding passage 25 is formed between the port 14 and the working chamber 23 in the body 5. A guiding passage 27 is formed in a lower part (the part opposite to the main valve hole 20 with respect to the main valve chamber 24) of the body 5. A stepped cylindrical valve drive member 29 is slidably inserted in the guiding passage 27.

The valve drive member 29 has an upper half part being reduced in diameter, extending through the main valve hole 20, and constituting a partition part 33 that separates the inside from the outside of the valve drive member 29. A stepped portion formed at a middle part of the valve drive member 29 constitutes a main valve element 30, which closes and opens the main valve by touching and leaving the main valve seat 22. The main valve element 30 touches and leaves the main valve seat 22 from the side of the main valve chamber 24 to close and open the main valve and thus control the flow rate of refrigerant flowing from the discharge chamber to the control chamber. The partition part 33 has an upper portion increasing upward in diameter into a tapered shape, and the sub-valve seat 34 is formed at an upper end opening of the partition part 33. The sub-valve seat 34 functions as a movable valve seat that displaces together with the valve drive member 29. Although the valve drive member 29 and the main valve element 30 are distinguished from each other in the present embodiment, the valve drive member 29 may alternatively be regarded as the "main valve element".

A cylindrical sub-valve element 36 is inserted in the guiding passage 25. An internal passage of the sub-valve element 36 forms the sub-valve hole 32. The internal passage connects the sub-valve chamber 26 and the working chamber 23 with each other when the sub-valve is opened. The sub-valve element 36 and the sub-valve seat 34 are at positions facing each other along the axial direction. The sub-valve element 36 touches and leaves the sub-valve seat 34 in the sub-valve chamber 26 to close and open the sub-valve.

An elongated actuating rod 38 is also provided along the axis of the body 5. An upper end part of the actuating rod 38 extends through the sub-valve element 36 and is operably connected with the power element 6. A lower end part of the actuating rod 38 is connected to a plunger 50, which will be described later, of the solenoid 3. An upper half part of the actuating rod 38 extends through the valve drive member 29, and has an upper portion being reduced in diameter. The sub-valve element 36 is mounted (outserted) around the reduced-diameter portion and fixed by press fitting. An end of the reduced-diameter portion is connected to the power element 6.

A ring-shaped spring support 40 is fitted into and supported by a middle portion in the axial direction of the actuating rod 38. A spring 42 (functioning as a "second biasing member") for biasing the valve drive member 29 in the valve closing direction of the main valve and the sub-valve is mounted between the valve drive member 29 and the spring support 40. During control of the main valve, the valve drive member 29 and the spring support 40 are tensioned by the elastic force of the spring 42, and the main valve element 30 and the actuating rod 38 move integrally.

The power element 6 includes a bellows 45, which senses the suction pressure Ps and is displaced thereby. The displacement of the bellows 45 generates a counterforce against the solenoid force. The counterforce is also transmitted to the main valve element 30 via the actuating rod 38 and the sub-valve element 36. When the sub-valve element 36 touches the sub-valve seat 34 to close the sub-valve, the release of refrigerant from the control chamber to the suction chamber is blocked. When the sub-valve element 36 leaves the sub-valve seat 34 to open the sub-valve, the release of refrigerant from the control chamber to the suction chamber is permitted.

The solenoid 3 includes a stepped cylindrical core 46, a bottomed cylindrical sleeve 48 mounted in such a manner as to seal off a lower end opening of the core 46, a stepped cylindrical plunger 50 contained in the sleeve 48 and disposed opposite to the core 46 along the axial direction, a cylindrical bobbin 52 mounted (outserted) around the core 46 and the sleeve 48, an electromagnetic coil 54 wound around the bobbin 52 and configured to generate a magnetic circuit when power is supplied thereto, a cylindrical casing 56 provided in such a manner as to cover the electromagnetic coil 54 from outside, an end member 58 provided in such a manner as to seal off a lower end opening of the casing 56, and a collar 60 made of a magnetic material embedded in the end member 58 at a position below the bobbin 52. The core 46, the casing 56, and the collar 60 constitute a yoke. In addition, the body 5, the end member 13, the core 46, the casing 56, and the end member 58 constitute the body of the entire control valve 1.

The valve unit 2 and the solenoid 3 are secured in such a manner that the lower end part of the body 5 is press-fitted into an upper end opening of the core 46. A working chamber 28 is formed between the core 46 and the valve drive member 29. The actuating rod 38 is inserted in and through the center of the core 46 in the axial direction. The working chamber 28 communicates with the working chamber 23 through the internal passages in the valve drive member 29 and the sub-valve element 36. Thus, the suction pressure Ps in the working chamber 23 is also introduced into the working chamber 28. The suction pressure Ps is also introduced into the sleeve 48 via a communication passage 62 formed by a spacing between the actuating rod 38 and the core 46.

A spring 44 (functioning as a "first biasing member") for biasing the core 46 and the plunger 50 in directions away from each other is mounted therebetween. The spring 44 functions as a so-called off-spring for opening the main valve while the solenoid 3 is powered off. The actuating rod 38 is coaxially connected with each of the sub-valve element 36 and the plunger 50. The actuating rod 38 has an upper portion press-fitted into the sub-valve element 36 and a lower end portion press-fitted into the upper portion of the plunger 50. The actuating rod 38, the sub-valve element 36, and the plunger 50 constitute a "movable member", which is displaced integrally with the valve drive member 29 during control of the main valve.

The actuating rod 38 appropriately transmits the solenoid force, which is a suction force generated between the core 46 and the plunger 50, to the main valve element 30 and the sub-valve element 36. At the same time, a drive force (also referred to as a "pressure-sensing drive force") generated by an extraction/contraction movement of the power element 6 is exerted on the actuating rod 38 against the solenoid force. Thus, while the main valve is controlled, a force adjusted by the solenoid force and the pressure-sensing force acts on the main valve element 30 to appropriately control the opening degree of the main valve. At the startup of the compressor, the actuating rod 38 is displaced relative to the body 5 against the biasing force of the spring 44 and according to the magnitude of the solenoid force, and lifts up the sub-valve element 36 to open the sub-valve after closing the main valve. Even during the control of the main valve, when the suction pressure Ps becomes substantially high, the actuating rod 38 is displaced relative to the body 5 against the biasing force of the bellows 45, and lifts up the sub-valve element 36 to open the sub-valve after closing the main valve. This achieves the bleeding function.

The sleeve 48 is made of a nonmagnetic material. A communicating groove 66 is formed in parallel with the axis on a lateral surface of the plunger 50, and a communicating hole 68 connecting the inside and the outside of the plunger 50 is provided in a lower portion of the plunger 50. Such a structure enables the suction pressure Ps to be introduced into a back pressure chamber 70 through a spacing between the plunger 50 and the sleeve 48 even when the plunger 50 is located at a bottom dead point as shown in FIG. 1.

A pair of connection terminals 72 connected to the electromagnetic coil 54 extend from the bobbin 52, and are led outside through the end member 58. For convenience of explanation, FIG. 1 shows only one of the pair of connection terminals 72. The end member 58 is installed in such a manner as to seal the entire structure inside the solenoid 3 contained in the casing 56 from below. The end member 58 is formed by molding (injection molding) a corrosion-resistant plastic material, and the plastic material also fills a spacing between the casing 56 and the electromagnetic coil 54. With the spacing between the casing 56 and the electromagnetic coil 54 filled with the plastic material in this manner, heat generated by the electromagnetic coil 54 is easily conducted to the casing 56, which increases the heat release performance Ends of the connection terminals 72 are led out from the end member 58 and connected to a not-shown external power supply.

Figure 2:
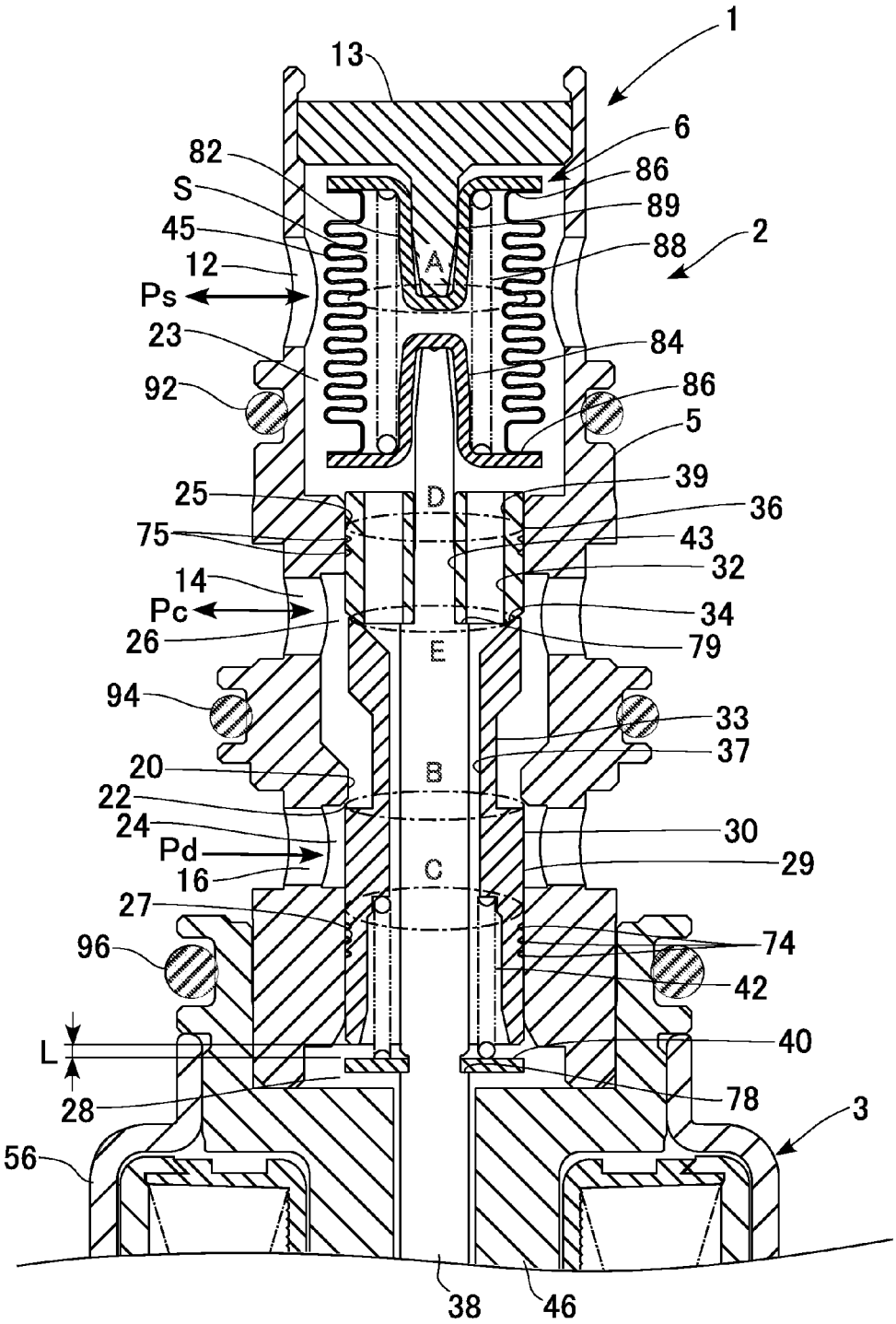
FIG. 2 is a partially enlarged cross-sectional view of the upper half of FIG. 1.

FIG. 2 is a partially enlarged cross-sectional view of the upper half of FIG. 1.

A labyrinth seal 74 having a plurality of annular grooves for restricting passage of refrigerant is formed on a sliding surface of the valve drive member 29 sliding relative to the guiding passage 27. The spring support 40 is made of a so-called E-ring supported in such a manner as to be fitted into an annular groove formed in a middle part of the actuating rod 38 and located in the working chamber 28.

A lower half of the valve drive member 29 has an enlarged inner diameter, and the spring 42 is disposed in such a manner as to be contained in the enlarged-diameter portion. With such a structure, since a contact point between the spring 42 and the valve drive member 29 is located nearer to the main valve chamber 24 with respect to the center of a sliding portion of the guiding passage 27, the valve drive member 29 is stably supported by the spring 42 in such a state as what is called a balancing toy. As a result, occurrence of hysteresis due to wobbling of the main valve element 30 being opened or closed can be prevented or reduced.

The sub-valve element 36 has an insertion hole 43 extending through the center thereof in the axial direction. An upper part of the actuating rod 38 extends through the insertion hole 43 up to the power element 6. The sub-valve element 36 is stopped by a stepped portion 79 that is a base end of the reduced-diameter portion of the actuating rod 38, so as to be positioned with respect to the actuating rod 38. A plurality of internal passages 39 for connecting an internal passage 37 of the valve drive member 29 and the working chamber 23 with each other are formed around the insertion hole 43 of the sub-valve element 36. The internal passages 39 extend in parallel with the insertion hole 43 and pass through the sub-valve element 36. A labyrinth seal 75 is provided on a sliding surface of the sub-valve element 36 sliding relative to the guiding passage 25. In the state shown in FIG. 2 in which the sub-valve element 36 is seated on the sub-valve seat 34, the stepped portion 79 of the actuating rod 38 is positioned so that the upper surface of the spring support 40 is separated from the lower surface of the valve drive member 29 with at least a predetermined spacing L therebetween. The predetermined spacing L functions as a so-called "play (looseness)".

As the solenoid force is increased, the actuating rod 38 can be displaced relative to the main valve element 30 (valve drive member 29) to lift up the sub-valve element 36. This separates the sub-valve element 36 and the sub-valve seat 34 from each other to thus open the sub-valve. In addition, the solenoid force can be directly transmitted to the main valve element 30 in a state in which the spring support 40 and the main valve element 30 are engaged (in contact) with each other, and the main valve element 30 can be pressed with a great force in the valve closing direction of the main valve. This structure functions as a lock release mechanism for releasing a locked state where the main valve element 30 is locked owing to a foreign material stuck between the sliding portions of the main valve element 30 and the guiding passage 27.

The main valve chamber 24 is a pressure chamber formed coaxially with the body 5 and having a larger diameter than the main valve hole 20. A relatively large space is thus formed between the main valve and the port 16, which can ensure a sufficient flow rate of refrigerant flowing through the main passage when the main valve is opened. Similarly, the sub-valve chamber 26 is a pressure chamber also formed coaxially with the body 5 and having a larger diameter than the main valve hole 20. Thus, a relatively large space is also formed between the sub-valve and the port 14. As illustrated in FIG. 2, an attachment and detachment portion between the upper end of the valve drive member 29 and the lower end of the sub-valve element 36 is positioned in the middle of the sub-valve chamber 26. In other words, a movable range of the main valve element 30 is set so that the sub-valve seat 34 is always located in the sub-valve chamber 26, and the sub-valve is thus opened and closed inside the sub-valve chamber 26. This can ensure a sufficient flow rate of refrigerant flowing through the sub-passage when the sub-valve is opened. That is, the bleeding function can be effectively achieved.

The power element 6 includes a first stopper 82 closing an upper end opening of the bellows 45 and a second stopper 84 closing a lower end opening thereof. The bellows 45 functions as a "pressure sensing member", and the first stopper 82 and the second stopper 84 function as "base members". The first stopper 82 is coaxially supported by the end member 13. The stoppers 82 and 84 are formed into a bottomed cylindrical shape by press forming a metal material, each having a flange portion 86 extending radially outward at an end opening thereof. The bellows 45 has a bellows body. An upper end opening of the body is welded to the flange portion 86 of the first stopper 82 in an airtight manner, and a lower end opening of the body is welded to the flange portion 86 of the second stopper 84 in an airtight manner. The inside of the bellows 45 is a hermetically-sealed reference pressure chamber S, and a spring 88 for biasing the bellows 45 in an expanding (stretching) direction is disposed between the first stopper 82 and the second stopper 84 on an inner side of the bellows 45. The reference pressure chamber S is in a vacuum state in the present embodiment.

The end member 13 is a fixed end of the power element 6. The end member 13 has a support portion 89 protruding downward from a lower face thereof. The support portion 89 is coaxially fitted into the first stopper 82 to support the first stopper 82 from above. An end of the support portion 89 locks a bottom portion of the first stopper 82 to restrict upward displacement of the power element 6. The amount by which the end member 13 is press-fitted into the body 5 can be adjusted, so that a set load of the power element 6 (a set load of the spring 88) can be adjusted.

The middle part of the first stopper 82 extends downward and inward of the bellows 45, and the middle part of the second stopper 84 extends upward and inward of the bellows 45, which form an axial core of the bellows 45. The upper end part of the actuating rod 38 is fitted into the second stopper 84. The bellows 45 expands (stretches) or contracts in the axial direction (in the valve opening/closing direction of the main valve and the sub-valve) according to a pressure difference between the suction pressure Ps in the working chamber 23 and a reference pressure in the reference pressure chamber S. A drive force in the valve opening direction based on the displacement of the bellows 45 is applied to the main valve element 30. Even when the pressure difference becomes large, the second stopper 84 comes into contact with the first stopper 82 and is stopped thereby at the point where the bellows 45 has contracted by a predetermined amount, and the contraction is thus restricted.

In the present embodiment, an effective pressure receiving diameter A of the bellows 45, an effective pressure receiving diameter B (sealing diameter) of the main valve element 30 in the main valve, a sliding portion diameter C (sealing diameter) of the valve drive member 29, and a sliding portion diameter D (sealing diameter) of the sub-valve element 36 are set to be equal. The term "equal" used herein may be deemed to include not only a concept of being exactly equal but also a concept of almost equal (substantially equal). In the state in which the valve drive member 29 and the power element 6 are operably connected with each other, the influences of the discharge pressure Pd, the control pressure Pc, and the suction pressure Ps acting on a combined unit of the main valve element 30 and the sub-valve element 36 connected with each other are thus cancelled. As a result, while the main valve is controlled, the main valve element 30 performs the valve opening or closing function on the basis of the suction pressure Ps received by the power element 6 in the working chamber 23. That is, the control valve 1 functions as a so-called Ps sensing valve.

In the present embodiment, the influences of the pressures (Pd, Pc, and Ps) acting on the valve element can be cancelled by setting the diameters B, C, and D to be equal to one another and making the internal passage pass through the valve element (the main valve element 30 and the sub-valve element 36) vertically. Specifically, the pressures before and after (above and below in FIG. 2) a combined unit of the sub-valve element 36, the valve drive member 29, the actuating rod 38, and the plunger 50 connected with one another can be set to an equal pressure (suction pressure Ps), which achieves pressure cancellation. As a result, the diameters of the valve elements can be set independent of the diameter of the bellows 45, which achieves high design flexibility. Thus, in a modification, while the diameters B, C, and D are set to be equal, the effective pressure receiving diameter A may be different therefrom. Specifically, the effective pressure receiving diameter A of the bellows 45 may be smaller than the diameters B, C, and D or larger than the diameters B, C, and D.

In the present embodiment, a sealing diameter E of the sub-valve element 36 in the sub-valve is smaller than the sealing diameter B of the main valve element 30 in main valve, and a pressure difference (Pc−Ps) between the control pressure Pc and the suction pressure Ps acts on the valve drive member 29 in the valve opening direction of the sub-valve. Such a pressure receiving structure and the biasing structure of the spring 42 constitute a "differential pressure valve opening mechanism" configured to open the sub-valve when the pressure difference (Pc−Ps) becomes a preset pressure difference $\Delta P_{set}$ or larger.

An O-ring 92 is fitted into an outer surface of the body 5 between the port 12 and the port 14, and an O-ring 94 is fitted into the outer surface between the port 14 and the port 16. Furthermore, an O-ring 96 is also fitted into the outer surface near the upper end of the core 46. These O-rings 92, 94, and 96 have a sealing function, and restricts leakage of refrigerant when the control valve 1 is mounted in a mounting hole of the compressor.

Next, operation of the control valve will be described.

In the present embodiment, the pulse width modulation (PWM) technique is employed for controlling power supply to the solenoid 3. The PWM control is performed by a not-shown controller by supplying a pulsed current with a frequency of about 400 Hz set at a predetermined duty ratio. The controller includes a PWM output unit configured to output a pulse signal with a specified duty ratio. Since a known configuration is used for the controller, detailed description thereof will be omitted.

Figure 3:
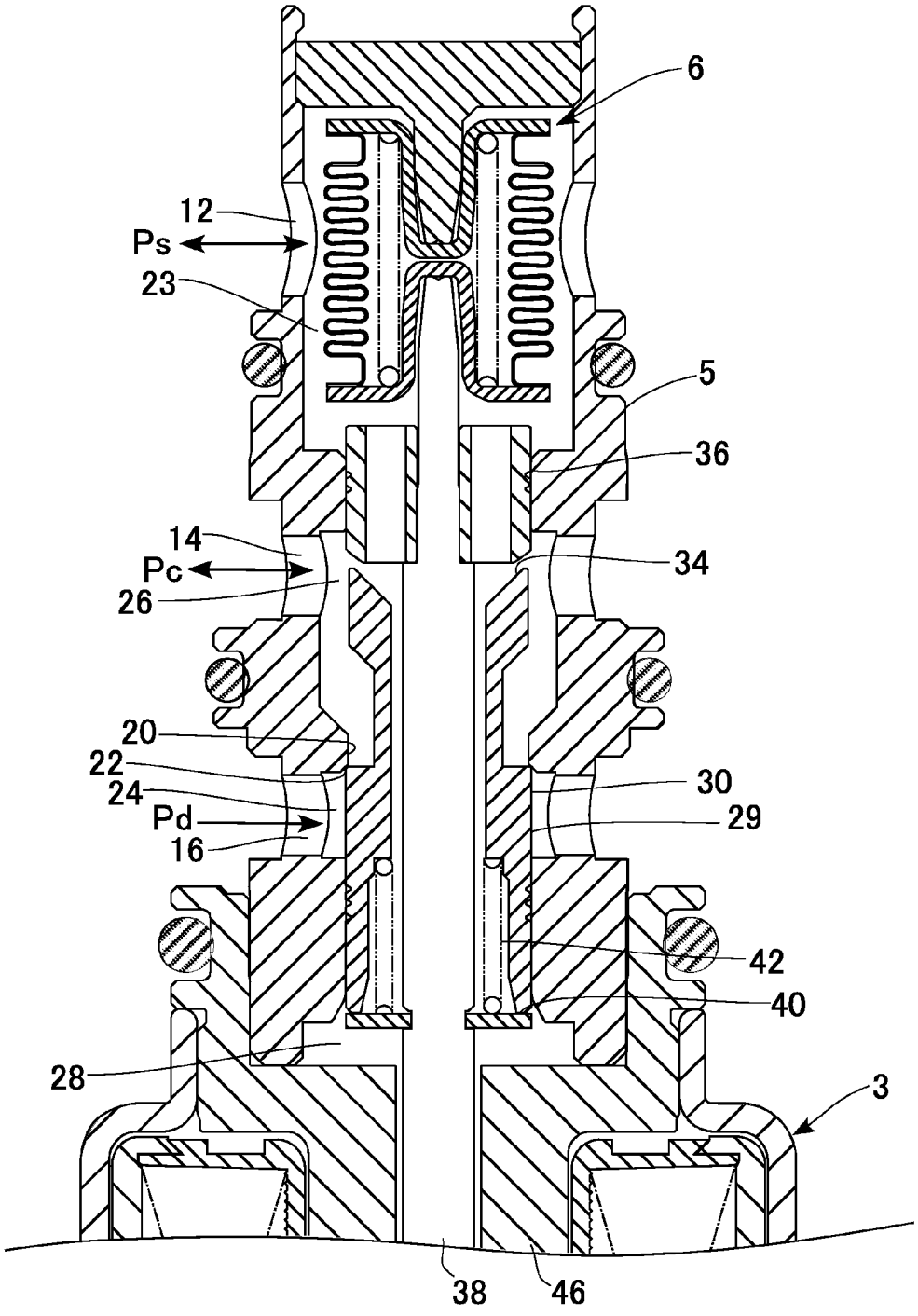
FIG. 3 illustrates operation of the control valve.
Figure 4:
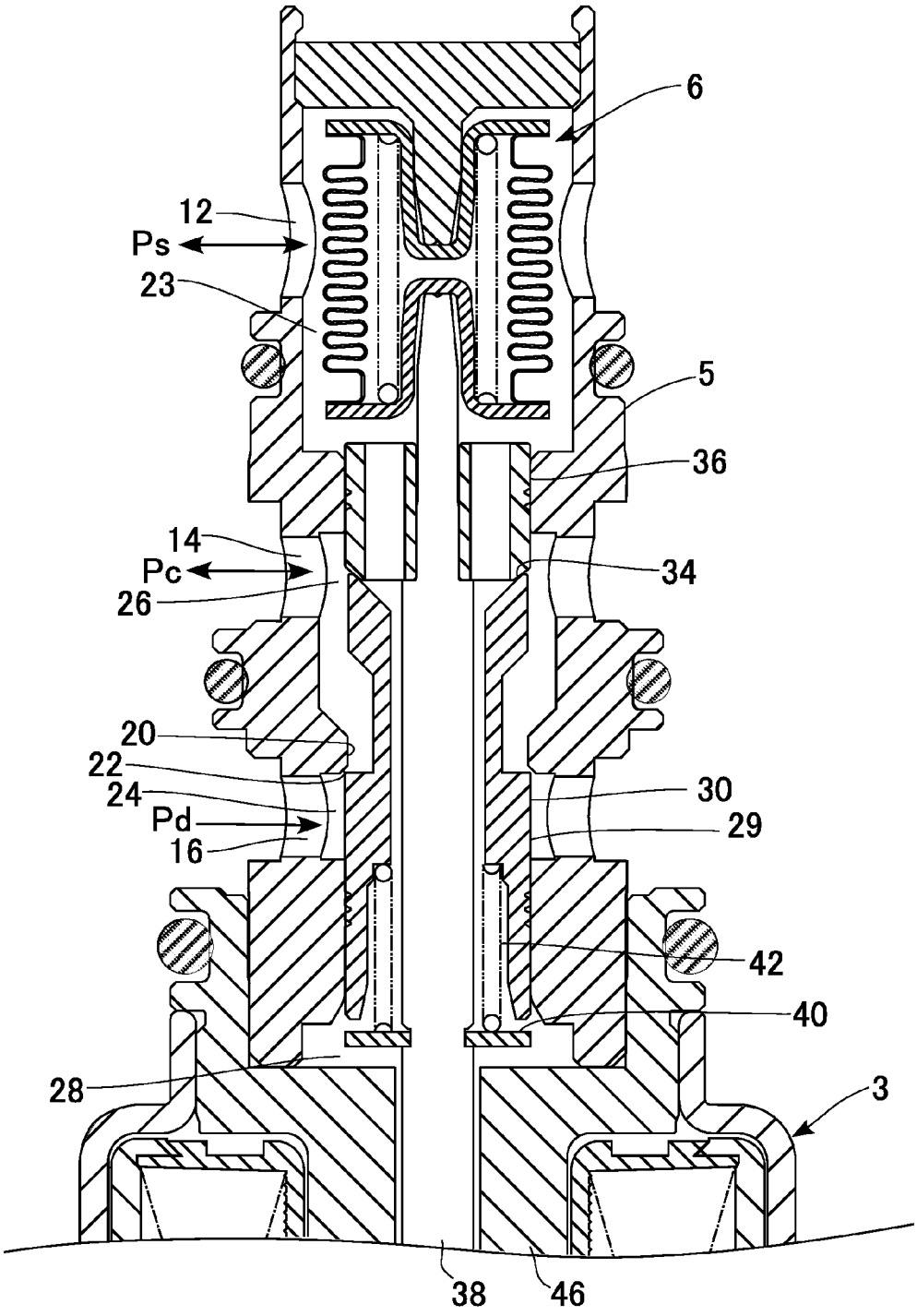
FIG. 4 illustrates operation of the control valve.
Figure 5:
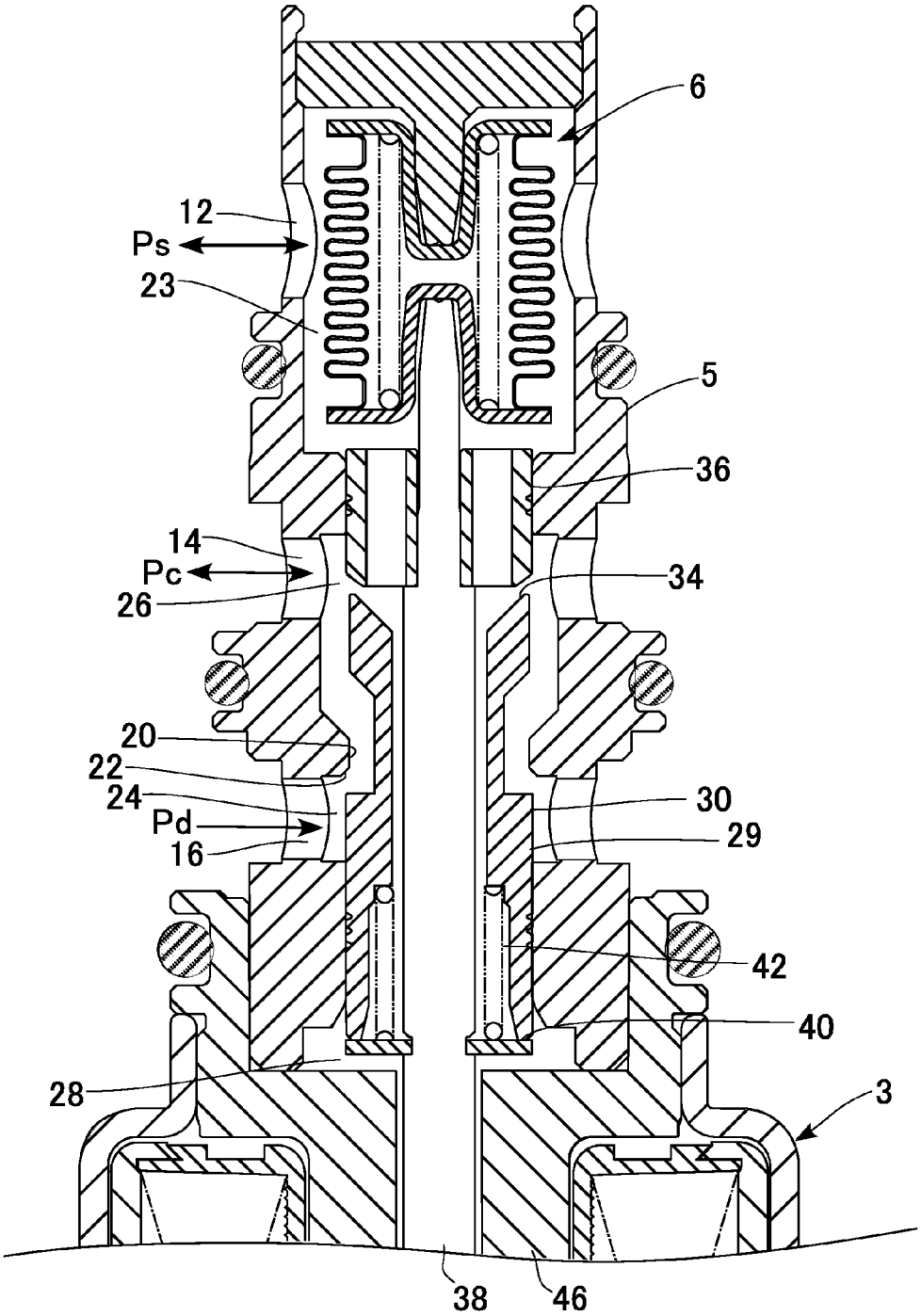
FIG. 5 illustrates operation of the control valve.

FIGS. 3 to 5 illustrate operation of the control valve. FIG. 2, which is described above, illustrates a minimum capacity operation state. FIG. 3 illustrates a state in which the bleeding function is made to work when the control valve is started or the like. FIG. 4 illustrates a relatively stable control state. FIG. 5 illustrates a state in which the control pressure Pc is excessively high while the solenoid 3 is powered off. Hereinafter, description will be given according to FIG. 1 with reference to FIGS. 2 to 5 where appropriate.

In the control valve 1, while the solenoid 3 is powered off, that is, while the automotive air conditioner is not in operation, the suction force does not act between the core 46 and the plunger 50. In the meantime, the biasing force of the spring 44 is transmitted to the main valve element 30 via the plunger 50, the actuating rod 38, and the sub-valve element 36. As a result, as illustrated in FIG. 2, the main valve element 30 is separated from the main valve seat 22 and the main valve becomes in a fully open state. In this process, the sub-valve remains in the closed state.

When a starting current is supplied to the electromagnetic coil 54 of the solenoid 3 at the startup of the automotive air conditioner, the sub-valve is opened as illustrated in FIG. 3 if the suction pressure Ps is higher than a valve opening pressure (also referred to as a "sub-valve opening pressure") set according to the supplied current value. Specifically, the solenoid force exceeds the biasing force of the spring 42, and the sub-valve element 36 is integrally lifted up. As a result, the sub-valve element 36 is separated from the sub-valve seat 34 and the sub-valve is opened, by which the bleeding function is effectively achieved. During this operation, the main valve element 30 is lifted up by the biasing force of the spring 42, and touches the main valve seat 22. As a result, the main valve is closed. Specifically, after the main valve is closed and introduction of discharged refrigerant into the control chamber is restricted, the sub-valve is opened and refrigerant in the control chamber is quickly released to the suction chamber. This enables the compressor to be quickly started. Note that the "sub-valve opening pressure" changes with a change in a preset pressure $P_{set}$, which will be described later, depending on the environment of the vehicle.

When the current value supplied to the solenoid 3 is within a control current value range for the main valve, the opening degree of the main valve is autonomously regulated so that the suction pressure Ps becomes the preset pressure $P_{set}$ set by the supplied current value. In this control state of the main valve, the sub-valve element 36 is seated on the sub-valve seat 34 and the sub-valve remains in the closed state as illustrated in FIG. 4. Since the suction pressure Ps is relatively low, the bellows 45 expands and the main valve element 30 moves to regulate the opening degree of the main valve. In this process, the main valve element 30 stops at a valve lifted position where the force in the valve opening direction generated by the spring 44, the force in the valve closing direction from the solenoid, and the force in the valve opening direction generated by the power element 6 depending on the suction pressure Ps are balanced.

When the refrigeration load is increased and the suction pressure Ps becomes higher than the preset pressure $P_{set}$, for example, the bellows 45 contracts, and the main valve element 30 is thus displaced relatively upward (in the valve closing direction). As a result, the valve opening degree of the main valve becomes smaller, and the compressor operates to increase the discharging capacity. Consequently, the suction pressure Ps changes in the lowering direction. Conversely, when the refrigeration load becomes smaller and the suction pressure Ps becomes lower than the preset pressure $P_{set}$, the bellows 45 expands. As a result, the power element 6 biases the main valve element 30 in the valve opening direction, increasing the valve opening degree of the main valve, and the compressor operates to reduce the discharging capacity. Consequently, the suction pressure Ps is kept at the preset pressure $P_{set}$. If the suction pressure Ps becomes significantly higher than the preset pressure $P_{set}$, the main valve may be closed and the sub-valve may be opened depending on the magnitude of the suction pressure Ps. Since, however, there is a pressure range (dead zone) after the main valve is closed until the sub-valve is opened, such a situation in which the main valve and the sub-valve are opened and closed unsteadily is prevented.

If the engine load is increased while such steady control is performed and the load on the air conditioner is to be reduced, the solenoid 3 of the control valve 1 is switched off from the on state. Since the suction force then does not act between the core 46 and the plunger 50, the main valve element 30 is separated from the main valve seat 22 by the biasing force of the spring 44 and the main valve becomes in the fully open state. In this process, since the sub-valve element 36 is basically seated on the sub-valve seat 34, the sub-valve becomes in the valve closed state. As a result, refrigerant at the discharge pressure Pd introduced from the discharge chamber of the compressor through the port 16 passes through the fully open main valve and flows through the port 14 to the control chamber. Thus, the control pressure Pc becomes higher and the compressor operates with a minimum capacity.

When the pressure difference (Pc−Ps) becomes the preset pressure difference $\Delta P_{set}$ or larger during switching to the minimum capacity operation, however, the differential pressure valve opening mechanism is activated as illustrated in FIG. 5. Specifically, a force caused by the pressure difference (Pc−Ps) exceeds the biasing force of the spring 42, and presses the valve drive member 29 downward to open the sub-valve. This prevents or reduce sudden increase in the control pressure Pc. The preset pressure difference $\Delta P_{set}$ is set to a value larger than the maximum value of possible pressure difference (Pc−Ps) acting on the valve drive member 29 during stable control of the main valve. Thus, basically, the sub-valve is not opened during control of the main valve. The differential pressure valve opening mechanism is different from the valve opening mechanism for forcedly opening the sub-valve by means of the solenoid 3 illustrated in FIG. 3 in that the differential pressure valve opening mechanism opens the sub-valve while the main valve is open.

In the present embodiment, since the main valve element 30 and the sub-valve seat 34 are formed integrally with the valve drive member 29, the action of the differential pressure valve opening mechanism not only opens the sub-valve but also increases the valve opening degree of the main valve. Furthermore, the sealing diameter of the main valve is larger than that of the sub-valve. If the opening degrees alone of the main valve and the sub-valve are considered, the effect of the differential pressure valve opening mechanism may be viewed as being hardly expected. A compressor, however, is typically provided with an orifice (also referred to as a "leak orifice") through which the control chamber and the suction chamber communicate with each other, in addition to the sub-valve of the control valve 1. The leak orifice allows the refrigerant in the control chamber to always leak toward the suction chamber. The combined effect of the functions of the leak orifice and the differential pressure valve opening mechanism as a whole achieves suppression of the increase in the control pressure Pc. As will be described later, in a modification, the main valve element and the sub-valve seat may be separate components, and the effect of the differential pressure valve opening mechanism may be achieved in a direct manner.

Figure 6A:
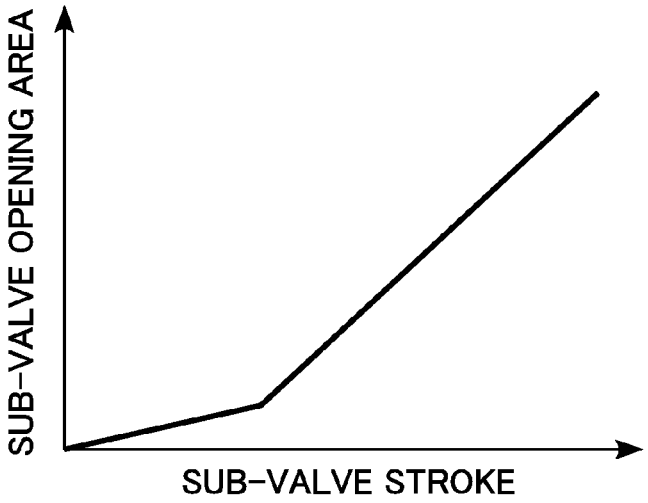
FIGS. 6A to 6C are graphs showing valve opening characteristics of the control valve.
Figure 6B:
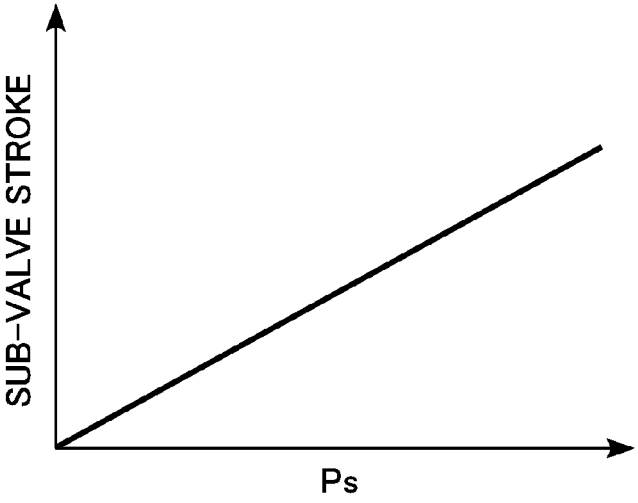
Figure 6C:
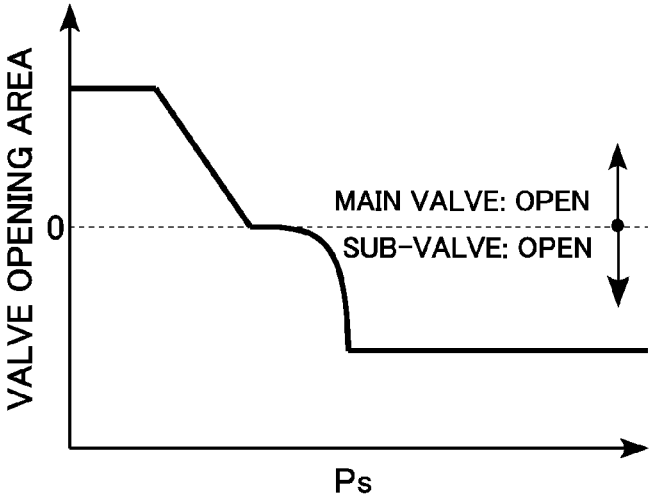

FIGS. 6A to 6C are graphs showing the valve opening characteristics of the control valve 1. FIG. 6A shows the valve opening characteristic of the sub-valve, in which the horizontal axis represents the sub-valve stroke (the amount by the sub-valve element 36 is lifted from the sub-valve seat 34) and the vertical axis represents the opening area of the sub-valve. FIG. 6B shows the valve opening characteristic of the sub-valve, in which the horizontal axis represents the suction pressure Ps and the vertical axis represents the sub-valve stroke. FIG. 6C shows the valve opening characteristics of the main valve and the sub-valve, in which the horizontal axis represents the suction pressure Ps and the vertical axis represents the opening area of each of the valves. If the supplied current value is constant, the magnetic gap of the solenoid 3 becomes larger as the suction pressure Ps lower, and the magnetic gap is smaller as the suction pressure Ps is higher.

As shown in FIG. 6A, the amount of change in the opening area of the sub-valve is set to be small in a range where the sub-valve starts opening, that is, in a range where the stroke is small, and then becomes larger when the stroke is a predetermined stroke or larger. This is because the surfaces of the sub-valve seat 34 and the sub-valve element 36, which come into contact with each other, are tapered with respect to the axis as illustrated in FIG. 3, etc. Even if the sub-valve is slightly opened during control of the main valve, such a structure as above reduces the influence of the slightly-opened sub-valve on the control. Specifically, since the power supply to the solenoid 3 is controlled using the PWM technique in the present embodiment, vibration caused by the PWM control may cause the sub-valve to open. If the main valve element 30 hits the main valve seat 22 when the main valve is slightly open, for example, the impact may cause the sub-valve to open. In particular, the likelihood of causing the sub-valve to open is high when the load of the spring 42 is set to be low. Even if the sub-valve is slightly opened in such a case, this does not substantially affects the control of the main valve owing to the above structure.

In addition, as shown in FIG. 6B, the sub-valve stroke is set to change linearly with respect to (in proportion to) the suction pressure Ps. This allows the sub-valve to open greatly when the suction pressure Ps has increased and exceeded a certain value as shown in FIG. 6C. As a result, the bleeding function is quickly exerted in the state of high suction pressure Ps, which achieves efficient air conditioning function.

In the present embodiment, as described above, when the solenoid 3 is powered off and the pressure difference (Pc–Ps) between the control pressure Pc and the suction pressure Ps thus becomes the preset pressure difference $\Delta P_{set}$ or larger, the differential pressure valve opening mechanism is activated to open the sub-valve. This prevents or reduces excessive increase in the control pressure Pc, and avoids such problems as leakage of refrigerant to the outside through a sealing portion inside the compressor.

Furthermore, in the present embodiment, the amount of change in the opening area of the sub-valve is set to be small in a range where the sub-valve starts opening. As a result, even if the sub-valve opens during control of the main valve, this does not affect the control of the main valve. Note that the differential pressure valve opening mechanism need not be essential when a main purpose is "to avoid the influence of the opening of the sub-valve on the mail valve control performance" as described above.

Second Embodiment

Figure 7A:
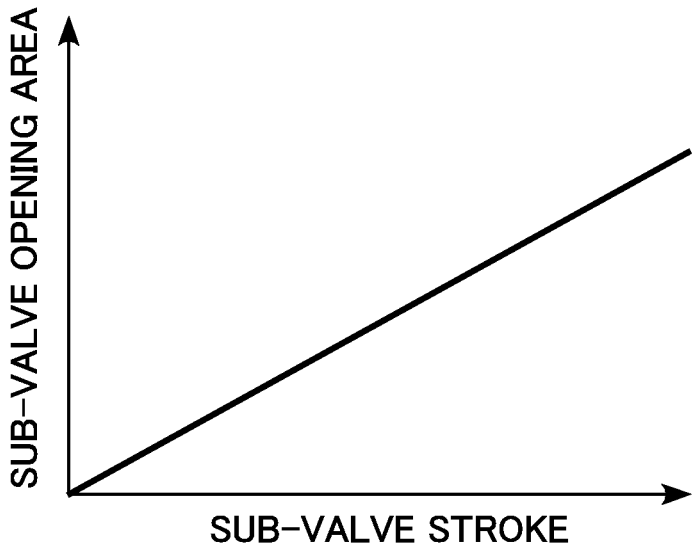
FIGS. 7A and 7B are graphs showing valve opening characteristics of a control valve according to a second embodiment.
Figure 7B:
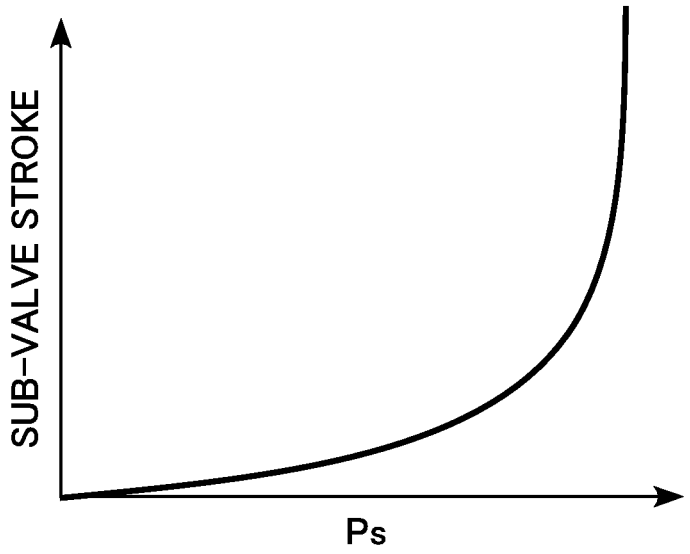

FIGS. 7A and 7B are graphs showing the valve opening characteristics of a control valve according to a second embodiment. FIG. 7A shows the valve opening characteristic of the sub-valve, the horizontal axis represents the sub-valve stroke and the vertical axis represents the opening area of the sub-valve. FIG. 7B shows the valve opening characteristic of the sub-valve, the horizontal axis represents the suction pressure Ps and the vertical axis represents the sub-valve stroke. Hereinafter, differences from the first embodiment will be mainly described.

The present embodiment is different from the first embodiment in the valve opening characteristic of the sub-valve. Specifically, as shown in FIG. 7A, the amount of change in the opening area of the sub-valve is set to change linearly (proportionally) from when the sub-valve starts opening to when the sub-valve is fully open. This linear change can be set by forming the surfaces of the sub-valve seat 34 and the sub-valve element 36, which come into contact with each other, into flat surfaces perpendicular to the axis.

In addition, as shown in FIG. 7B, the valve opening characteristic is set as follows: as the suction pressure Ps becomes higher, the opening degree of the sub-valve becomes gradually larger, and when the suction pressure Ps has reached a preset fully-opening pressure, the opening degree sharply changes to the fully-open state. Such a valve opening characteristic can be set based on the relation between the suction force characteristic of the solenoid 3 and the drive force characteristic (load characteristic) of the power element 6. Specifically, this valve opening characteristic can be achieved in such a manner that the slope of the suction force characteristic of the solenoid 3 is set greater than that of the drive force characteristic of the power element 6 from the point where the suction pressure Ps is the fully-opening pressure, which are characteristics that change with the change in the magnetic gap of the solenoid 3 with the suction pressure Ps. In a modification, the valve opening characteristic of the sub-valve may be set to include both the characteristic shown in FIG. 6A and that shown in FIG. 7B, for example.

The present embodiment and the modification can also produce the same effects as those of the first embodiment. Furthermore, similarly to the first embodiment, the present embodiment and the modification achieves the purpose of "avoiding the influence of the opening of the sub-valve on the main valve control performance".

Third Embodiment

Figure 8A:
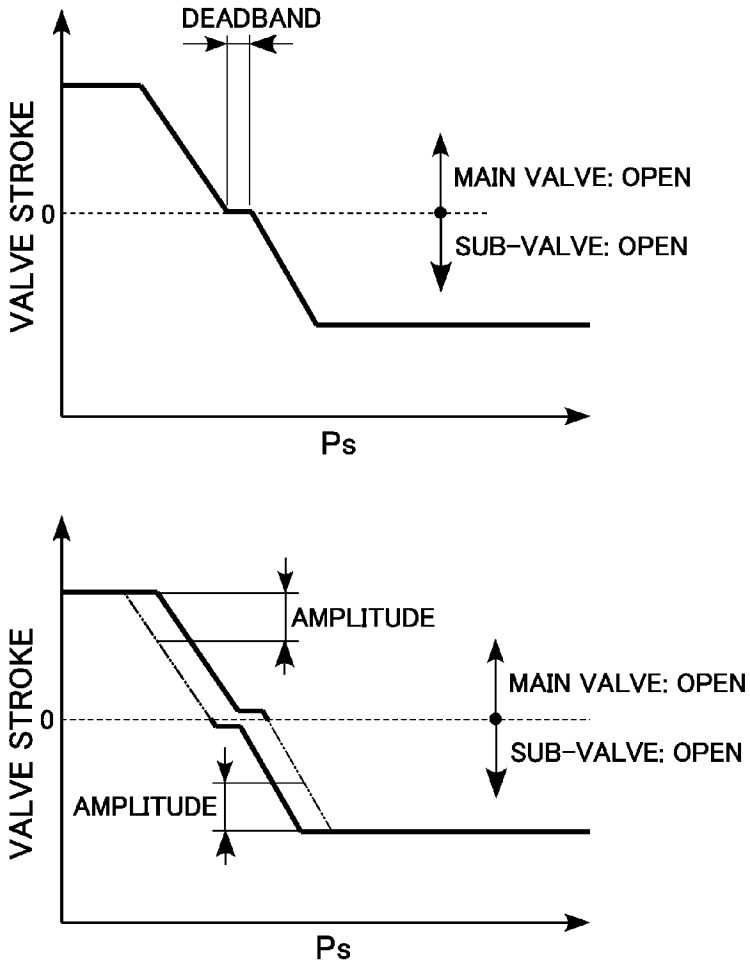
FIGS. 8A and 8B are graphs showing valve opening characteristics of a control valve according to a third embodiment.
Figure 8B:
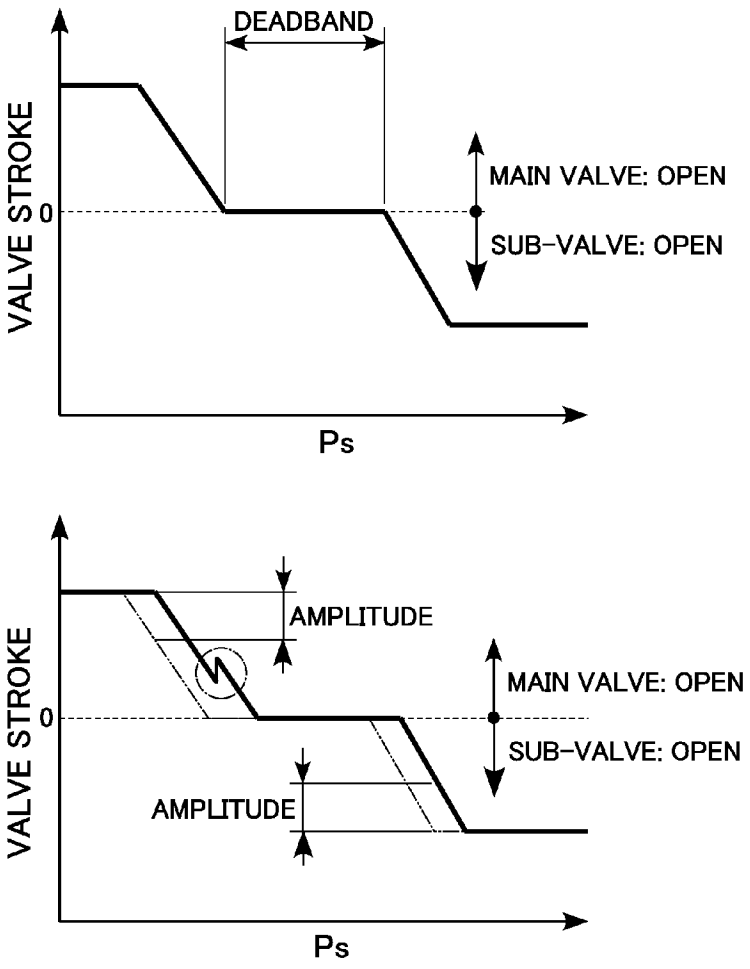

FIGS. 8A and 8B are graphs showing the valve opening characteristics of a control valve according to a third embodiment. FIG. 8A shows the valve opening characteristics according to the present embodiment, and FIG. 8B shows the valve opening characteristics according to a comparative example. The upper graphs of FIGS. 8A and 8B show settings of deadbands in which both of the main valve and the sub-valve are closed. The lower graphs thereof show the open/closed states of the valves under the settings. In FIGS. 8A and 8B, the horizontal axes represent the suction pressure Ps and the vertical axes represent the valve stroke. Hereinafter, differences from the first embodiment will be mainly described.

In the present embodiment, the "deadband", which is a state in which both of the main valve and the sub-valve are closed after the closure of the main valve and before the opening of the sub-valve, is set to be small, so as to prevent or reduce rebounding of the main valve element 30 from the main valve seat 22. Specifically, in the control valve where the PWM control is employed as described above, the main valve element 30 strokes while generating microvibration to the PWM frequency (of about 400 Hz, for example). Thus, in a case where the deadband is set to be large as in the comparative example shown in FIG. 8B (the upper graph in FIG. 8B), when the main valve becomes a slightly open state, the main valve element 30 may hit the main valve seat 22 and rebound therefrom depending on the amplitude of vibration (the lower graph in FIG. 8B). The distance between a solid line and an alternate long and two short dashed line in FIG. 8B represents the vibration amplitude of each valve. If the rebound of the main valve element 30 causes the opening degree of the main valve to be large (see an alternate long and short dashed line), this may lead to unintended increase in the suction pressure Ps.

In view of the above, in the present embodiment, the deadband is set to be small as shown in FIG. 8A (the upper graph in FIG. 8A), so that the sub-valve can be readily opened when the main valve is slightly open. Even if the main valve element 30 rebounds to increase the opening degree of the main valve, such a configuration is capable of suppressing an increase in the control pressure Pc, and thus an increase in the suction pressure Ps (the lower graph in FIG. 8A). The distance between a solid line and an alternate long and two short dashed line in FIG. 8A represents the vibration amplitude of each valve. In other words, the collision energy of the main valve element 30 can be released in the form of the activation energy of the sub-valve. Such stabilization of the control pressure Pc results in absorption of the vibration of the main valve element 30 and suppression of the rebound itself. Consequently, unintended increase in the suction pressure Ps is suppressed.

Such a configuration in which the sub-valve can be readily open when the main valve is slightly open allows the leak orifice of the compressor to be smaller, for example. This enables the compressor to quickly move to the minimum capacity operation when the solenoid 3 is turned off, which increases the operating efficiency of the air conditioner. The size of the "deadband" can be set on the basis of the load (biasing force) of the spring 42, to such a size that the sub-valve starts opening when the main valve is slightly open (before the main valve is fully closed), for example. Specifically, the deadband may be set so that the sub-valve starts opening when a range where the vibration caused by the power supply control unit the PWM technique makes the main valve element 30 hit the main valve seat 22 is entered. Alternatively, the deadband may be set so that the sub-valve starts opening when the opening degree of the main valve becomes equal to or smaller than the vibration amplitude resulting from the PWM control and before the main valve is fully closed. According to the present embodiment, a state in which both the main valve and the sub-valve open at the same time is present before the main valve becomes completely closed.

The description of the present invention given above is based upon illustrative embodiments. These embodiments are intended to be illustrative only and it will be obvious to those skilled in the art that various modifications could be further developed within the technical idea underlying the present invention.

Although not mentioned in the above-described embodiments, the sum of the maximum opening area of the sub-valve and the opening area of the leak orifice may be set to be larger than the maximum opening area of the main valve. In addition, the total flow rate of the refrigerant flowing through the sub-valve and the leak orifice while the sub-valve is fully open may be set to be greater than that of the refrigerant flowing through the main valve while the main valve is fully open. This allows the control pressure Pc to be reduced to some extent to activate the compressor even when the actuation of the main valve element is locked in the fully-open state of the main valve, for example. In other words, the air-conditioning function of the air conditioner can be ensured to some extent.

In the above-described embodiments, examples in which the main valve element 30 and the sub-valve seat 34 are integrally provided have been presented. In a modification, these members may be separate members. Specifically, a valve drive member may be formed separately from the main valve element 30, and the sub-valve seat 34 may be formed as a "movable valve seat" on the valve drive member. In this case as well, when the pressure difference (Pc−Ps) becomes a preset pressure difference $\Delta P_{set}$ or larger, the valve drive member is displaced to open the sub-valve.

In the above-described embodiments, examples in which the sub-valve element 36 is fixed to the actuating rod 38 have been presented. In a modification, the sub-valve element 36 and the actuating rod 38 may be displaceable relative to each other. Specifically, the sub-valve element 36 illustrated in FIG. 2 may be slidably inserted in the actuating rod 38 and a spring (which functions as a "biasing member") configured to bias the sub-valve element 36 in the valve closing direction may be provided. For example, the spring may be disposed between the sub-valve element 36 and the power element 6. The displacement of the sub-valve element 36 in the valve closing direction is, however, restricted by the stepped portion 79 of the actuating rod 38. In such a structure, a preset pressure difference $\Delta P_{set}$ may be set such that, when the pressure difference (Pc−Ps) becomes the preset pressure difference $\Delta P_{set}$ or larger, the load caused by the preset pressure difference $\Delta P_{set}$ exceeds the load of the spring and the sub-valve element 36 displaces away from the sub-valve seat 34. This structure allows the sub-valve to open wider when the pressure difference (Pc−Ps) becomes a preset pressure difference $\Delta P_{set}$ or larger, which enhances the effect of suppressing an increase in the control pressure Pc.

In the above-described embodiments, examples in which the spring 42 is disposed between the valve drive member 29 and the actuating rod 38 as illustrated in FIG. 2 have been presented. In a modification, the spring 42 may be disposed between the valve drive member 29 and the core 46 (the body of the control valve 1).

In the embodiments described above, the so-called Ps sensing valve including the power element 6 placed in the working chamber 23 filled with the suction pressure Ps and operating upon directly sensing the suction pressure Ps has been presented as the control valve. In a modification, the control valve may be a so-called Pc sensing valve operating upon sensing the control pressure Pc as a pressure to be sensed instead of the suction pressure Ps. Alternatively, the control valve may be a differential pressure regulating valve having no power element and operating upon sensing a pressure difference by movable members including a valve element. For example, the control valve may be a Pd−Ps differential pressure regulating valve operating so that the pressure difference (Pd−Ps) between the discharge pressure Pd and the suction pressure Ps becomes a preset pressure difference. Alternatively, the control valve may be a Pd−Pc differential pressure regulating valve operating so that the pressure difference (Pd−Pc) between the discharge pressure Pd and the control pressure Pc becomes a preset pressure difference.

While an example in which the bellows 45 is used as the pressure sensing member constituting the power element 6 has been described in the embodiment described above, a diaphragm may be used instead. In this case, a plurality of diaphragms may be connected in the axial direction to achieve operating strokes required for a pressure sensing member.

While springs that are biasing members (elastic members) are used for the springs 42, 44, etc. in the embodiments described above, it goes without saying that elastic materials such as rubber and plastics may be used instead.

While the reference pressure chamber S inside the bellows 45 is in a vacuum state in the embodiments described above, the reference pressure chamber S may be filled with air or a predetermined reference gas. Alternatively, the reference pressure chamber S may be filled with any one of the discharge pressure Pd, the control pressure Pc, and the suction pressure Ps. The power element may thus operate upon sensing a pressure difference between the inside and the outside of the bellows as appropriate. Furthermore, while the structure in which the pressures Pd, Pc, and Ps directly received by the main valve element are cancelled is presented in the embodiments described above, a structure in which at least one of these pressures is not cancelled may be used.

The present invention is not limited to the above-described embodiments and modifications only, and the components may be further modified to arrive at various other embodiments without departing from the scope of the invention. Various other embodiments may be further formed by combining, as appropriate, a plurality of structural components disclosed in the above-described embodiments and modification. In addition, one or some of all of the components exemplified in the above-described embodiments and modifications may be left unused or removed.

What is claimed is:

1. A control valve for a variable displacement compressor, for varying a discharging capacity of the compressor for compressing refrigerant introduced into a suction chamber and discharging the compressed refrigerant from a discharge chamber, by regulating a flow rate of refrigerant introduced from the discharge chamber to a control chamber, the control valve comprising:

a body having a main passage through which the discharge chamber and the control chamber communicate with each other, and a sub-passage through which the control chamber and the suction chamber communicate with each other;

a main valve seat provided in the main passage;

a main valve element configured to touch and leave the main valve seat to close and open a main valve;

a sub-valve seat provided in the sub-passage;

a sub-valve element configured to touch and leave the sub-valve seat to close and open a sub-valve;

a solenoid configured to generate a drive force in a valve closing direction of the main valve;

an actuating rod for transmitting the drive force of the solenoid to the main valve element and the sub-valve element;

a first biasing member for applying a biasing force to the main valve in a valve opening direction; and a second biasing member for applying a biasing force to the sub-valve in a valve closing direction;

wherein the sub-valve is configured to open when a pressure difference between a control pressure in the control chamber and a suction pressure in the suction chamber becomes a preset pressure difference or larger.

2. A control valve, for a variable displacement compressor, according to claim 1, wherein the pressure difference causes opening of the sub-valve while the main valve is open.

3. A control valve, for a variable displacement compressor, according to claim 2, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

4. A control valve, for a variable displacement compressor, according to claim 2, further comprising a valve drive member slidably supported by the body, wherein the sub-valve element is formed integrally with the actuating rod, wherein the sub-valve seat is formed integrally with the valve drive member, and wherein the second biasing member biases the valve drive member in the valve closing direction of the sub-valve.

5. A control valve, for a variable displacement compressor, according to claim 4, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

6. A control valve, for a variable displacement compressor, according to claim 4, wherein the body has a capacity chamber communicating with the control chamber, a valve chamber communicating with the discharge chamber, a working chamber into which the suction pressure is introduced, the main valve seat formed between the valve chamber and the capacity chamber, and a guiding passage formed between the valve chamber and the working chamber, wherein the valve drive member is slidably supported in the guiding passage and has formed therethrough an internal passage through which the capacity chamber and the working chamber communicate with each other, wherein the main valve element is formed integrally with the valve drive member in the valve chamber, the sub-valve seat is formed integrally with the valve drive member in the capacity chamber, a sealing diameter of the main valve element in the main valve and a sealing diameter of the valve drive member at a sliding portion slidable relative to the guiding passage are substantially equal, and wherein a sealing diameter of the sub-valve element in the sub-valve is smaller than the sealing diameter of the main valve element in the main valve and the pressure difference between the control pressure and the suction pressure acts on the valve drive member in a valve opening direction of the sub-valve.

7. A control valve, for a variable displacement compressor, according to claim 6, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

8. A control valve, for a variable displacement compressor, according to claim 1, further comprising a valve drive member slidably supported by the body, wherein the sub-valve element is formed integrally with the actuating rod, wherein the sub-valve seat is formed integrally with the valve drive member, and wherein the second biasing member biases the valve drive member in the valve closing direction of the sub-valve.

9. A control valve, for a variable displacement compressor, according to claim 8, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

10. A control valve, for a variable displacement compressor, according to claim 8, wherein the body has a capacity chamber communicating with the control chamber, a valve chamber communicating with the discharge chamber, a working chamber into which the suction pressure is introduced, the main valve seat formed between the valve chamber and the capacity chamber, and a guiding passage formed between the valve chamber and the working chamber, wherein the valve drive member is slidably supported in the guiding passage and has formed therethrough an internal passage through which the capacity chamber and the working chamber communicate with each other, wherein the main valve element is formed integrally with the valve drive member in the valve chamber, the sub-valve seat is formed integrally with the valve drive member in the capacity chamber, a sealing diameter of the main valve element in the main valve and a sealing diameter of the valve drive member at a sliding portion slidable relative to the guiding passage are substantially equal, and wherein a sealing diameter of the sub-valve element in the sub-valve is smaller than the sealing diameter of the main valve element in the main valve and the pressure difference between the control pressure and the suction pressure acts on the valve drive member in a valve opening direction of the sub-valve.

11. A control valve, for a variable displacement compressor, according to claim 10, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

12. A control valve, for a variable displacement compressor, according to claim 1, further comprising a power element functioning as a pressure sensing part configured to sense a predetermined pressure to be sensed and generate a drive force in the valve opening direction of the main valve depending on a magnitude of the sensed pressure, wherein the actuating rod is disposed between the pressure sensing part and the solenoid, and wherein an opening degree of the main valve is controlled so that the sensed pressure becomes a preset pressure corresponding to a value of current supplied to the solenoid.

* * * * *